US007731031B1

(12) United States Patent
Weinberger

(10) Patent No.: US 7,731,031 B1
(45) Date of Patent: Jun. 8, 2010

(54) CLEANUP KIT FOR COMPACT FLUORESCENT LIGHT BULBS AND ASSOCIATED METHODS

(76) Inventor: Larry Weinberger, 1440 Northridge Dr., Hailey, ID (US) 83333

( * ) Notice: Subject to any disclaimer, the term of this patent is extended or adjusted under 35 U.S.C. 154(b) by 0 days.

(21) Appl. No.: 12/629,532

(22) Filed: Dec. 2, 2009

Related U.S. Application Data

(60) Provisional application No. 61/119,094, filed on Dec. 2, 2008.

(51) Int. Cl.
*B65D 71/00* (2006.01)

(52) U.S. Cl. ..... 206/576

(58) Field of Classification Search ..... 206/569, 206/573, 575, 576, 577, 582, 225, 232, 38, 206/459.5
See application file for complete search history.

(56) References Cited

U.S. PATENT DOCUMENTS 4,917,238 A * 4/1990 Schumacher ..... 206/223
5,360,169 A 11/1994 Kohler
5,718,245 A * 2/1998 Horn ..... 128/897
5,862,916 A * 1/1999 Utecht ..... 206/570
6,454,097 B1 * 9/2002 Blanco ..... 206/570
7,410,054 B2 8/2008 Shatford et al.
2006/0214039 A1 9/2006 Domanico
2009/0231865 A1 9/2009 Ludtke, Jr. et al.

* cited by examiner

*Primary Examiner*—Jacob K Ackun, Jr.
(74) *Attorney, Agent, or Firm*—Jason A. Fischer, Esq.; Zies Widerman & Malek

(57) ABSTRACT

A compact fluorescent cleanup kit is disclosed, which comprises a plurality of member elements. The member elements comprise printed instructions, at least one glove, at least one mask, at least one eye protection member, at least one sealable container, at least one cleanup scoop, at least one single-sided adhesive member, and at least one towelette. The at least one glove, at least one mask, and at least one eye protection member may be donned to protect a user from exposure to metal contaminants that may be released when a compact fluorescent bulb is damaged. The at least one cleanup scoop, at least one single-sided adhesive member, and at least one towelette may be used to collect all debris from a damaged compact fluorescent bulb into the at least one sealable container.

20 Claims, 1 Drawing Sheet

CLEANUP KIT FOR COMPACT FLUORESCENT LIGHT BULBS AND ASSOCIATED METHODS

RELATED APPLICATIONS

This application claims the benefit of U.S. Provisional Application Ser. No. 61/119,094 filed on Dec. 2, 2008, the contents of which are incorporated herein in their entirety.

FIELD OF THE INVENTION

The present invention relates to the field of compact fluorescent bulbs and, more specifically, to the field of cleanup and disposal of compact fluorescent light bulbs.

BACKGROUND OF THE INVENTION

Compact fluorescent light bulbs (CFL) are becoming increasingly more common as they are a great way to conserve energy. More specifically, CFLs provide a substantial amount of illumination while using substantially less energy than traditional light bulbs. In fact, it has been found that CFLs may use up to about 75% less energy than traditional light bulbs. CFLs, however, contain metal contaminant material, i.e., Mercury. Accordingly, in the case of a breakage, there exists a danger of inhalation of Mercury vapor. Inhalation of Mercury vapor may lead to brain damage, birth defects, or any other number of dangerous illnesses. Statistics show that 1 in 6 children every year have been exposed to Mercury levels so high that they are at potentially at risk for learning disabilities, motor skills impairment and short-term memory loss. Further, the Mercury in one CFL can pollute 6,000 gallons of water beyond safe levels from drinking. Accordingly, there exists a need for a kit to be used to clean up and dispose of broken CFLs to minimize risks associated with the Mercury in a CFL.

Proposed solutions to the problem of spreading metal contaminants, which are found in CFLs, involve disposing of a CFL using an apparatus that may capture escaping contaminants. See, e.g., U.S. patent application Ser. No. 11/278,516 by Domanico. However, such solutions are inadequate for dealing with CFLs that may be unintentionally broken. Other proposed solutions to this problem involve using, for example, a complicated apparatus that submerges the CFL into a chemical bath. See, e.g., U.S. Pat. No. 5,360,169 to Köher. Such solutions are not practical for a residential or commercial setting. Other examples provide ways to safely store a CFL, containing contaminant metals when a CFL breaks inside of the proposed containment device, but these solutions fail to address the problem of cleaning up CFL debris when breakage occurs outside of a controlled environment. See, e.g., U.S. Pat. No. 7,410,054 to Shatford et al.; or U.S. patent application Ser. No. 12/151,408 by Ludtke, JR. et al.

SUMMARY OF THE INVENTION

As indicated above, there exists a need for an efficient cleanup kit to clean up damaged CFLs. The cleanup kit, according to an embodiment of the present invention, advantageously provides the tools necessary to easily capture and properly dispose of the debris that can result from damaged CFLs, without exposing the user to dangerous metal contaminants. According to a preferred embodiment of the present invention, a compact fluorescent cleanup kit is disclosed, which includes a plurality of member elements. The member elements comprise printed instructions, at least one glove, at least one mask, at least one eye protection member, at least one sealable container, at least one cleanup scoop, at least one single-sided adhesive member, and at least one towelette. The at least one glove, at least one mask, and at least one eye protection member may be donned to protect a user from exposure to metal contaminants that may be released when a compact fluorescent bulb is damaged. The at least one cleanup scoop, at least one single-sided adhesive member, and at least one towelette may be used to collect all debris from a damaged compact fluorescent bulb into the at least one sealable container.

Use of a cleanup kit, according to an embodiment of the present invention, should advantageously decrease the risk of exposure to metal contaminants, such as Mercury, contained in CFLs. Use of a cleanup kit, according to an embodiment of the present invention, for other broken light bulbs such as halogen light bulbs and incandescent light bulbs may also be advantageous and should decrease the risk of a user being injured by any broken glass.

DETAILED DESCRIPTION OF THE PREFERRED EMBODIMENTS

Figure 1:
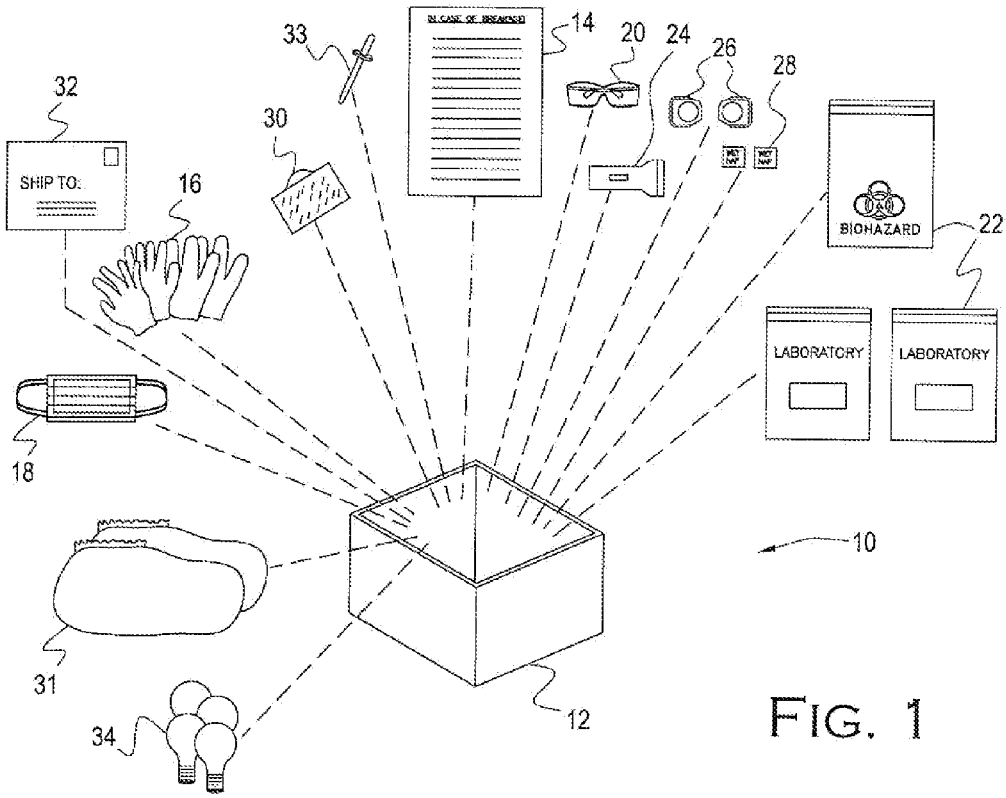
FIG. 1 is an exploded perspective view of a CFL cleanup kit according to an embodiment of the present invention.
Figure 2:
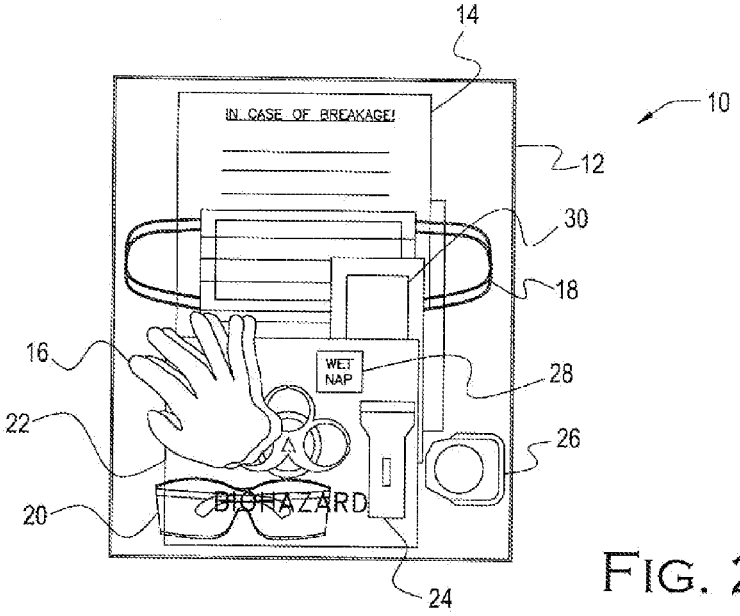
FIG. 2 is a perspective view of the CFL cleanup kit illustrated in FIG. 1 showing the components of the CFL cleanup kit positioned within a container or packaging.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

The CFL cleanup kit 10, according to an embodiment of the present invention, may illustratively include a main container 12 and a plurality of components carried therein. The plurality of components stored within a main container 12 of a CFL cleanup kit 10 may advantageously provide users with a convenient compilation of necessary supplies, to be used to clean up and properly dispose of broken CFLs. The number of CFLs in homes and businesses will greatly increase in the coming years, as CFLs will likely replace traditional light bulbs. Accordingly, it is advantageous for homeowners and businesses to have a CFL cleanup kit 10, according to an embodiment of the present invention, readily available to assist in properly cleaning up and disposing of broken CFLs.

A CFL cleanup kit 10 may preferably include printed instructions 14, at least one glove 16, at least one mask 18, at least one protective shoe-covering member 31, at least one eye protection member 20, at least one sealable container 22, at least one light source 24, at least one pipette 33, at least one cleanup scoop 26, at least one towelette 28, and at least one single-sided adhesive member 30. The main container 12 of a cleanup kit 10 may preferably be provided by a convenient quick and easy opening package, so that a user may advantageously and readily access the contents of the kit.

In a preferred embodiment, a typical cleanup kit 10 may include one set of printed instructions 14, at least one glove

16, which may be provided as two pairs of disposable gloves, at least one mask 18, which may be provided as one disposable mask, at least one protective shoe-covering member 31, which may be provided as a pair of polypropylene shoe covers, at least one eye protection member 20, which may be provided as one pair of eye protection, i.e., safety glasses, at least one sealable container 22, which may be provided as a biohazard bag, at least one light source 24, which may be provided as a flashlight, at least one cleanup scoop 26, which may be provided as two disposable cleanup scoops, at least one towelette 28, which may be provided as one pre-moistened towelette and one dry towelette, and at least one single-sided adhesive member 30, which may be provided as two pieces of single-sided adhesive strips.

Those skilled in the art will appreciate, after having the benefit of this disclosure, however, that any number of the components may be included within the main container 12 of a cleanup kit 10. Further, those skilled in the art, after having the benefit of this disclosure, will appreciate that the components of a cleanup kit 10, according to an embodiment of the present invention, may be provided in various sizes. In other words, it may be desirable for cleanup kits to be purchased and used for commercial applications as well as residential applications. Those skilled in the art will appreciate, after having the benefit of this disclosure, that commercial applications may require greater capacity than typical residential applications. Similarly, skilled artisans, after having the benefit of this disclosure, would recognize that various cleanup kits could be marketed and sold at different price points, depending on which components are provided with each. As a non-limiting example, a premium or deluxe version of a cleanup kit 10 could include more components than a basic or economy version of a cleanup kit 10.

Those skilled in the art, after having the benefit of this disclosure, will appreciate that a cleanup kit 10, according to an embodiment of the present invention, may also be used for cleaning up halogen-type light bulbs and incandescent light bulbs, which do not contain Mercury, as well as other products containing metal contaminants, e.g., switches, relays, thermometers, and other products that may include Mercury as understood by those skilled in the art.

The detailed instructions 14 in a cleanup kit 10, according to an embodiment of the present invention, may be printed on card-type material, or any other type of strong material that may withstand the test of time. It may be preferred that the indicia of the printed instructions 14 is in large, bold type, but after having the benefit of this disclosure, those skilled in the art will appreciate that any type is sufficient for the printed instructions. The printed instructions 14 preferably may include the following directions:

1. In case of breakage, immediately remove all children and pets from vicinity. If you are pregnant, stay away from area and have another person do the cleanup. DO NOT walk through the area of the breakage.
2. Make sure to open all exterior windows and turn off any ventilation such as air conditioning or heat.
3. Immediately leave the room for at least 15 minutes.
4. Retrieve your emergency cleanup kit. Pull quick release tab and lay contents out on a clean surface.
5. Prior to re-entering the room, carefully put on disposable gloves, included in kit, being careful not to rip or tear any area of the glove. Place mask, included, on your face, covering your nose and mouth. Place protective shoe covers, included, over your shoes. Put on your safety eyewear, included.
6. You are now ready to approach the debris area where the breakage occurred. Pick up any Mercury beads with eyedropper and place eyedropper into the sealable biohazard bag (included) or glass jar with metal lid (not included).
7. Very carefully use the pickup cards or disposable scoops provided to gather and pick up all broken glass, powder, and other debris in the area. Place the debris into the sealable biohazard bag (included) or glass jar with metal lid (not included).
8. After the area seems to be generally clean, pat the area with the sticky side of tape provided to remove any remaining fine particles or small residue.
9. Scan the area with the flashlight, included, to look for glittering residue, broken glass, and other missed debris.
10. Now open the moist towelette to wipe the area of any residue spotted with your flashlight, and then do a final wipe of the area with a dry towelette.
11. Then VERY CAREFULLY place wipes, pickup cards/scoops, adhesive tape, and mask into the sealable bag.
12. Remove the protective shoe covers, pulling from the ankle down. They must now be inside out. Place in sealable bag.
13. Lastly, remove your disposable gloves, pulling from the wrist down. They must now be inside out. Place in sealable bag and seal.
14. Immediately place the sealable bag in an outdoor container for disposal. DO NOT place with normal household garbage.
15. Finally, BE SURE to wash your hands and face after waste has been removed from the area.
16. Continue to ventilate the area for as long as possible, and contact your local recycling center for disposal instructions, or visit www.epa.gov or www.osha.gov.

The foregoing instructions are provided merely for illustrative purposes and are not intended as a limitation on the type, number, or content of printed instructions 14 that may be included with a cleanup kit 10, according to an embodiment of the present invention. More specifically, it would be apparent to those having skill in the art, after having the benefit of this disclosure, that additional instructions may be required where additional components are provided with a cleanup kit 10. It would be equally apparent to those skilled artisans, who have had the benefit of this disclosure, that there may be fewer instructions, where fewer components are provided with a cleanup kit 10. Optionally, printed instructions 14, according to an embodiment of the present invention, may list each state's website that contains instructions for proper disposal and recycling of hazardous materials.

A cleanup kit 10, according to an embodiment of the present invention, may also include printed instructions 14 that have been written in multiple languages, to allow for use in regions where more than a single language is prevalent amongst potential users. After having the benefit of this disclosure, it would be apparent to a person having skill in the art that printed instruction 14 may be provided on a sheet, which may be adapted to be carried by a main container 12. It would be equally apparent to such a skilled artisan who has had the benefit of this disclosure that printed instructions 14 may also be provided on the exterior or interior surface of a main container 12.

At least one glove 16, according to an embodiment of the present invention, may be provided as any type of glove. For example, but not intended as a limitation, at least one glove 16 may be nitrile or latex free gloves, as understood by those skilled in the art, or any other type of glove suitable for protecting the hands of a user. At least one mask 18, according to an embodiment of the present invention, may be provided as a surgical mask, for example, but not intended as a limitation, or any other type of mask suitable for reducing the chance of inhaling any portion of a broken CFL, as understood by those skilled in the art. At least one eye protection member 20, according to an embodiment of the present invention, may be preferably provided by safety glasses or any similar type of eye protection suitable for protecting the eyes of a user when cleaning up a broken CFL.

At least one sealable container 22, according to an embodiment of the present invention, may, for example, but not intended as a limitation, be provided by a sealable plastic bag, a biohazard bag, or a sealable rigid/semi-rigid container as understood by those skilled in the art. Optionally, at least one sealable container 22 may be provided by, for example, but not intended as a limitation, a laboratory bag, as understood by those having skill in the art. At least one light source 24, according to an embodiment of the present invention, may advantageously be provided as a mini-flashlight, and preferably a mini-flashlight having an included battery.

At least one cleanup scoop 26, according to an embodiment of the present invention, may be provided as cleanup cups, or cups having side wall and rear wall portions. Optionally, at least one cleanup scoop 26, according to an embodiment of the present invention, may be provided by, for example, but not intended as a limitation, a pickup card or scraper, which could be used to push debris into cleanup cups. At least one cleanup scoop 26 may be intended as a single-use scoop. When provided as such, a cleanup scoop 26 should not be reused after being used to clean up a broken CFL.

At least one towelette 28, according to an embodiment of the present invention, may be an anti-bacterial towelette, but those skilled in the art, after having the benefit of this disclosure, will appreciate that the purpose of a towelette is to clean up a broken CFL area, and accordingly may be provided by any moistened or dry cloth type of material. At least single-sided adhesive member 30, according to an embodiment of the present invention, may be provided by high-strength tape, such as duct tape, as a non-limiting example. Those skilled in the art, after having the benefit of this disclosure, will appreciate that any single-sided adhesive may be used to accomplish the goals and features of the present invention. For convenience, a single-sided adhesive member 30 may be provided by fixing one side of a double-sided adhesive tape to a rigid surface, which has a handle grip attached to its opposite surface. As a non-limiting example, a rectangular plastic card may provide an appropriate rigid surface. Further, one having skill in the art, after having the benefit of this disclosure, would recognize that a plastic card may be manufactured, such that a point at its center is distended, forming a handle that is suitable for gripping, while still providing an adequate opposite surface for fixing one side of a double-sided adhesive tape.

At least one pipette 33, according to an embodiment of the present invention, may be provided for capturing droplets of Mercury, which may be deposited on surfaces and pieces of debris, when a CFL has broken. It would be apparent, after having the benefit of this disclosure, to a person having skill in the art, that at least one pipette 33 may be provided as, for example, but not intended as a limitation, an eyedropper. At least one protective shoe-covering member 31, according to an embodiment of the present invention, may be provided for preventing the spread of metal contaminants that would otherwise come into contact with the soles of a user's footwear. It would be apparent, after having the benefit of this disclosure, to a person having skill in the art, that at least one protective shoe-covering member 31 may be provided as, for example, but not intended as a limitation, a polypropylene shoe cover, which is typically used in clean room environments, as understood by those skilled in the art.

It might also be advantageous to include in a cleanup kit 10, according to an embodiment of the present invention, a number of replacement CFLs 34. A person having skill in the art would recognize, after having the benefit of this disclosure, that a user would be more likely to employ a replacement CFL 34, in replacing a broken CFL, if that replacement CFL 34 was provided with a cleanup kit 10. After having the benefit of this disclosure, it would be apparent to a skilled artisan that, where a user is more likely to employ a CFL, the potential for energy savings may be increased, as CFLs may consume as much as 75% less energy than comparable incandescent bulbs. Including replacement CFLs 34 in the cleanup kit 10, according to an embodiment of the present invention, advantageously enhances the cleanup kit from a marketability perspective. In other words, the cleanup kit 10, according to an embodiment of the present invention, which includes replacement CFLs therein, is advantageous to the perspective customer, as the customer need only purchase one item, instead of purchasing both a cleanup kit and a separate CFL. This also enhances use of shelf space in retail stores, thereby increasing profitability.

A cleanup kit 10, according to an embodiment of the present invention, may preferably include a postage-paid package 32, which has been addressed to an appropriate recycling and disposal facility. A skilled artisan would recognize, after having the benefit of this disclosure, that a sealable container 22 may be deposited into a postage-paid package 32, after the sealable container 22 has been filled with debris from a broken CFL, and shipped to a facility that is equipped to properly dispose of or recycle spent CFLs. It would also be apparent to that skilled artisan, after having the benefit of this disclosure, that a number of shipping services provide prepaid packages. Standard U.S. mail, FedEx, and United Parcel Service (UPS) are three non-limiting examples of such services. As another option, a shipping label may be provided in place of or in addition to a postage-paid package 32. A skilled artisan, after having the benefit of this disclosure, would recognize that a shipping label may be adhered to a user-provided package, creating a suitable vessel for transporting a sealable container 22, which has been filled with debris from a broken CFL, to a facility that is equipped to property dispose of or recycle spent CFLs.

Upon opening and using a cleanup kit 10, according to an embodiment of the present invention, a user may properly dispose of all components of the cleanup kit. In other words, elements of a cleanup kit 10, according to an embodiment of the present invention, may be single-use components. When so provided, all single-use elements of a cleanup kit 10 are intended to be disposable. Accordingly, all of the components of the cleanup kit 10 may preferably be inexpensive. The components of a cleanup kit 10, according to an embodiment of the present invention, may also advantageously be easy to use, including easy-to-follow instructions that are provided within the main container 12 of a cleanup kit. Use of a cleanup kit 10, according to an embodiment of the present invention, should advantageously decrease the risk of exposure to metal contaminants, such as Mercury, contained in CFLs. Use of a cleanup kit 10, according to an embodiment of the present invention, for other broken light bulbs such as halogen light bulbs and incandescent light bulbs may also be advantageous and should decrease the risk of a user being injured by any broken glass.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A compact fluorescent light bulb cleanup kit comprising, in combination:

printed instructions;

at least one glove;

at least one mask;

at least one eye protection member;

at least one sealable container;

at least one cleanup scoop;

at least one single-sided adhesive member; and at least one towelette.

2. A compact fluorescent light bulb cleanup kit, according to claim 1, further comprising a main container.

3. A compact fluorescent light bulb cleanup kit, according to claim 2, wherein each of the at least one glove, at least one disposable mask, at least one eye protection member, at least one sealable container, at least one cleanup scoop, at least one single-sided adhesive member, and at least one towelette are adapted to be carried by the main container.

4. A compact fluorescent light bulb cleanup kit, according to claim 3, further comprising at least one light source, which is adapted to be carried by the main container.

5. A compact fluorescent light bulb cleanup kit, according to claim 4, wherein the at least one light source is a flashlight.

6. A compact fluorescent light bulb cleanup kit, according to claim 3, further comprising a pipette, which is adapted to be carried by the main container.

7. A compact fluorescent light bulb cleanup kit, according to claim 3, further comprising at least one of a shipping label and a postage-paid package addressed to a proper recycling and disposal facility, each of which is adapted to be carried by the main container.

8. A compact fluorescent light bulb cleanup kit, according to claim 3, further comprising at least one protective shoe-covering member, which is adapted to be carried by the main container.

9. A compact fluorescent light bulb cleanup kit, according to claim 3, further comprising at least one replacement compact fluorescent light bulb, which is adapted to be carried by the main container.

10. A compact fluorescent light bulb cleanup kit, according to claim 1, wherein the at least one sealable container comprise at least one biohazard bag.

11. A compact fluorescent light bulb cleanup kit, according to claim 1, wherein the at least one towelette comprise at least one pre-moistened towelette.

12. A compact fluorescent light bulb cleanup kit, according to claim 1, wherein the at least one towelette comprises at least one dry towelette.

13. A compact fluorescent light bulb cleanup kit, according to claim 2, wherein the printed instructions are printed on the main container.

14. A compact fluorescent light bulb cleanup kit, according to claim 2, wherein the printed instructions are printed on a separate sheet, which is adapted to be carried by the main container.

15. A compact fluorescent light bulb cleanup kit, according to claim 1, wherein the printed instructions describe a method of cleaning up a damaged compact fluorescent light bulb by using the kit.

16. A method of cleaning up a damaged compact fluorescent light bulb, using a compact fluorescent light bulb cleanup kit, wherein the kit comprises a main container, at least one glove, at least one disposable mask, at least one eye protection member, at least one cleanup scoop, at least one sealable container, at least one single-sided adhesive member, and at least one towelette, and wherein each of the at least one glove, the at least one disposable mask, the at least one eye protection member, the at least one cleanup scoop, the at least one sealable container, the at least one single-sided adhesive member, and the at least one towelette are adapted to be carried by the main container, the method comprising the steps of:

donning the at least one glove;

donning the at least one disposable mask;

donning the at least one eye protection member;

pushing larger pieces of a broken fluorescent light bulb into the at least one cleanup scoop;

discarding the larger pieces of the damaged compact fluorescent light bulb into the at least one sealable container;

blotting the affected area with the at least one single-sided adhesive member, thereby attaching smaller pieces of the damaged compact fluorescent light bulb thereto;

discarding the at least one single-sided adhesive member into the at least one sealable container;

wiping the affected area with the at least one towelette; and discarding the at least one towelette into the at least one sealable container.

17. A method according to claim 16 further comprising the step of illuminating the affected area with at least one light source, which is adapted to be carried by the main container, to reveal pieces of the damaged compact fluorescent light bulb and droplets of contaminant metal.

18. A method of according to claim 16, further comprising the steps of:

capturing any visible droplets of contaminant metal with at least one pipette, which is adapted to be carried by the main container; and discarding the at least one pipette into the at least one sealable container.

19. A method according to claim 16, further comprising the steps of:

sealing the at least one sealable container;

depositing the at least one sealable container within at least one of a user-provided package bearing a shipping label and a postage-paid package, wherein each of the shipping label and the postage paid package is adapted to be carried by the main container; and shipping at least one of the user-provided package bearing a shipping label and the postage-paid package to a proper recycling and disposal facility.

20. A method according to claim 16 further comprising the step of donning at least one protective shoe-covering member, which is adapted to be carried by the main container.

* * * * *